US007370594B2

(12) United States Patent
Bruckner et al.

(10) Patent No.: US 7,370,594 B2
(45) Date of Patent: May 13, 2008

(54) SYSTEM FOR REDUCING THE ROLL OF A BOAT

(75) Inventors: Simone Bruckner, Genoa (IT); Massimiliano Cotterchio, Savona (IT); Marco Murru, Abbasanta (IT)

(73) Assignee: Azimut-Benetti S.p.A., Viareggio (IT)

( * ) Notice: Subject to any disclaimer, the term of this patent is extended or adjusted under 35 U.S.C. 154(b) by 0 days.

(21) Appl. No.: 11/544,952

(22) Filed: Oct. 6, 2006

(65) Prior Publication Data

US 2007/0089659 A1 Apr. 26, 2007

(30) Foreign Application Priority Data

Oct. 7, 2005 (IT) ..... TO2005A0710

(51) Int. Cl.
*B63B 39/00* (2006.01)

(52) U.S. Cl. ..... 114/122

(58) Field of Classification Search ..... 114/122, 114/125

See application file for complete search history.

(56) References Cited

U.S. PATENT DOCUMENTS 5,263,432 A 11/1993 Davis
5,385,110 A 1/1995 Bennett et al.
6,845,782 B2 * 1/2005 Osterkil et al. ..... 137/1
7,069,913 B1 * 7/2006 Crary ..... 123/509

FOREIGN PATENT DOCUMENTS

| | | |
|---|---|---|
| GB | 380051 | 9/1932 |
| GB | 419028 | 11/1934 |
| GB | 475437 | 11/1937 |
| GB | 1037338 | 7/1966 |
| JP | 7-251793 | 10/1995 |
| WO | 84/04904 | 12/1984 |
| WO | 98/380081 | 9/1998 |

* cited by examiner

*Primary Examiner*—Stephen Avila
(74) *Attorney, Agent, or Firm*—Merchant & Gould P.C.

(57) ABSTRACT

Two fuel tanks are situated on opposite sides of the central longitudinal axis of a boat. An inclinometer generates electric signals indicating the inclination of the boat about its longitudinal axis. The two tanks are connected hydraulically by at least one pipe with which a pump is associated. An electronic processing and control unit acquires and processes the signals emitted by the inclinometer and operates the pump, depending on said signals, so as to transfer fuel from one tank to another in order to reduce the inclination of the boat.

6 Claims, 1 Drawing Sheet

SYSTEM FOR REDUCING THE ROLL OF A BOAT

BACKGROUND OF THE INVENTION

Figure 1:
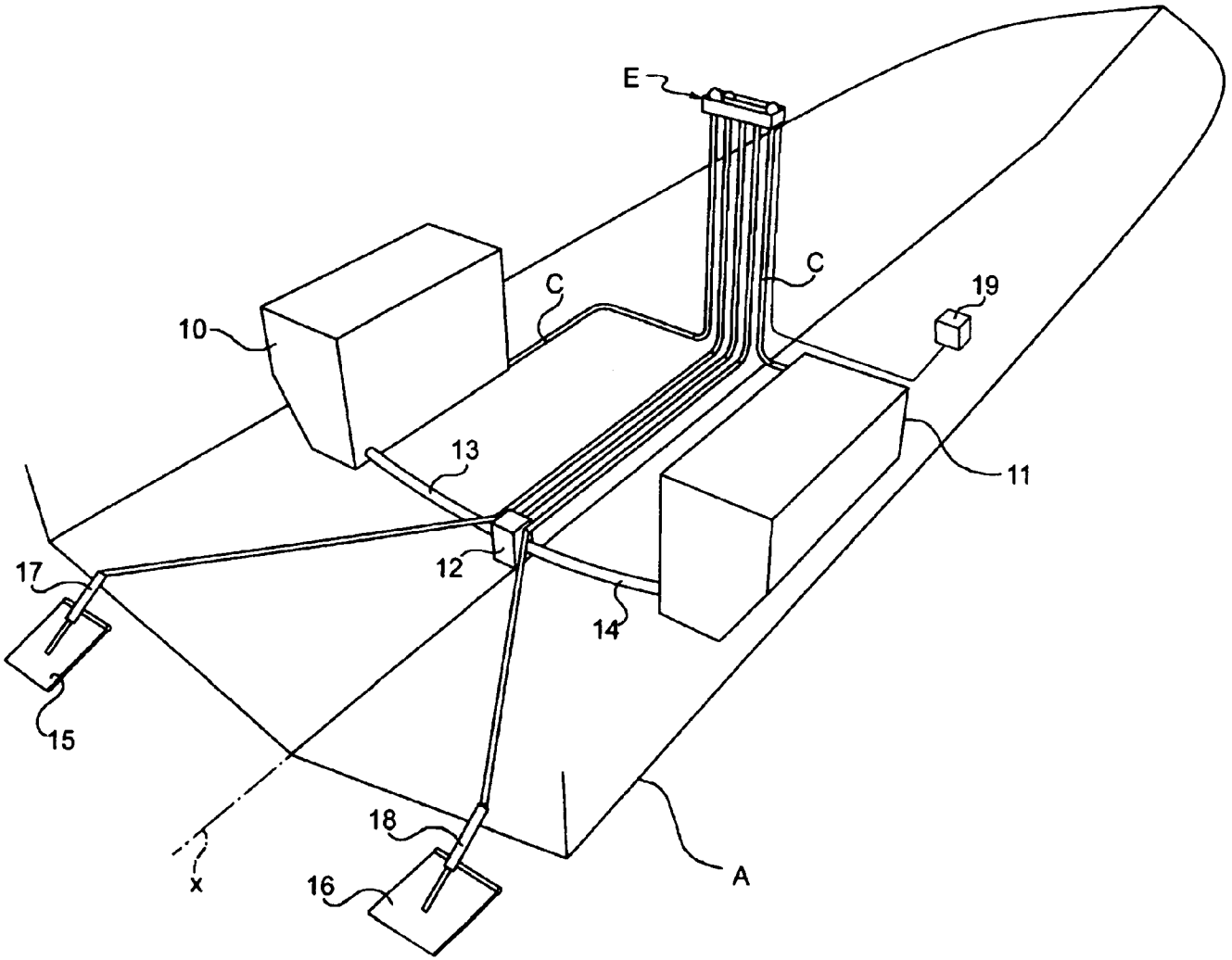

The present invention relates to a system for reducing the roll of a boat. The invention is intended to be used in particular on yachts.

Boats are continuously subject to oscillating movements with respect to both the rolling axis and the pitching axis. These oscillating movements are due to external forces acting on the boat (sea, wind, current, etc.) and/or to the distribution of the loads on-board the boat. In this latter case the causes of the imbalance may be temporary phenomena (for example the movement of persons or objects on-board or differences in level between liquid-containing vessels or tanks) or permanent phenomena, for example the installation of special fixed plants or accessories.

Various systems and apparatus for reducing the roll, the pitching and other undesirable movements of a boat, by means of the transfer of liquids, are known. Ballast tanks inside which seawater may be pumped in order to ensure the stability or correct trim of a boat are widely used.

The Japanese patent application JP-7-251793 describes a water tank for boats. The tank has the shape of a "U" with two opposite arms and is associated with a pump which introduces selectively compressed air into the branches of the tank. The air is introduced at a pressure calculated depending on the signals received from an inclinometer.

SUMMARY OF THE INVENTION

The object of the present invention is to provide a system by means of which it is possible to adjust in an efficient manner the trim of a boat without making it heavier, using as far as possible apparatus, devices and components which are already provided on most boats.

These and other objects and advantages, which will be understood more clearly below, are achieved according to the invention by a system having the characteristic features defined in the accompanying claims.

A preferred, but non-limiting embodiment of the invention will now be described; reference is made to the accompanying drawing which is a schematic perspective view of the system according to the invention applied to a boat.

BRIEF DESCRIPTION OF THE DRAWING(S)

With reference to the drawing, 10 and 11 indicate two fuel tanks which are transversely spaced from each other and situated on opposite sides of the longitudinal axis x of a boat schematically designated "A".

DETAILED DESCRIPTION OF THE PREFERRED EMBODIMENT(S)

In the whole of the present description and in the claims, the terms and the expressions indicating positions and directions are understood as referring to the mounted condition on a boat. For example, the term "longitudinal" indicates a direction parallel to the longitudinal axis (fore-and-aft) of the boat.

A pump 12 is mounted on the boat and is connected hydraulically to both the tanks 10 and 11 by means of respective pipes 13, 14.

Some of the apparatus and the devices mentioned here are known per se and will therefore not be described in detail.

15, 16 denote respective hydrodynamic fins (also referred to as "hydrofoils" or "flaps") which are operated by respective oil-hydraulic actuators 17, 18. The fins 15, 16, which are commonly used to correct the trim of the boat at various speeds, are mounted in the aft zone of the boat on opposite sides of the longitudinal axis x.

An inclinometer 19 measures the degree of roll, i.e. the inclination of the boat with respect to its longitudinal axis x.

E denotes schematically an electronic control unit, preferably a PLC (Programmable Logic Controller) or PC (Personal Computer), which is electrically connected to the pump 12, to the actuators 17, 18 and to the inclinometer 19.

According to the invention, the operation of the pump 12 and the movements of the actuators 17, 18 are adjusted by means of commands imparted to them by the control unit E. The control unit E acquires in real time from the inclinometer 19 a signal indicating the instantaneous value and the angular direction of the roll, as well as data relating to the instantaneous speed of the boat, supplied by the on-board instruments (not shown). The control unit E is equipped with an application software for restoring the transverse trim of the boat in the manner described hereinbelow.

In the stationary condition, i.e. when the boat is stopped or inclined at a substantially constant roll angle, the electronic unit E emits an electric signal activating the pump 12 in order to transfer, via the pipes 13 and 14, a certain quantity of fuel from one of the tanks 10 (or 11) to the other tank 11 (or 10), depending on the direction of inclination detected. The pump thus continues to transfer fuel from one tank to the other until the inclinometer signals a zero transverse trim condition (zero roll).

Depending on the signals supplied by the inclinometer, the electronic unit E is able to recognise a dynamic situation, when the boat is moving and/or the roll angle varies beyond a predetermined angular range. In these conditions, the operation of the pump 12 may be co-ordinated with the adjustment of the actuators 17, 18. The latter are actuated in order to position the two respective fins 15, 16 at varied angles of immersion in order to reduce as far as possible the inclination of the boat.

It will be understood that the adjustment of the trim by means of the hydrodynamic fins is in theory faster than that which can be obtained by means of transfer of fuel from one tank to another. The unit E may therefore be preset to deactivate automatically the pump 12 when the frequency of the oscillations exceeds a predetermined value, beyond which the pump cannot produce a significant stabilizing effect. In these conditions it will be possible to perform only "dynamic" stabilization by means of the hydrodynamic fins.

The persons skilled in the art will recognise that the person steering the boat will have access to a detailed graphic interface for operation and control of the pump 12 and/or the actuators 17, 18. Alternatively or in addition it is possible to envisage a simple key for automatically activating the unit E which automatically monitors operation of the system as a whole and therefore also operation of all the other actuating or sensing devices described here.

Each tank is preferably provided with a respective low level sensor connected electrically to the unit E by means of a cable C, in order to prevent the removal of fuel from the tank when the level of the fuel inside that tank is situated below a predetermined threshold. It is likewise also possible to arrange inside each tank a respective high level sensor, which is also electrically connected to the unit E, in order to prevent the supply of fuel to a tank which is substantially full or nearly full.

As can be appreciated, the invention allows stabilization of a boat and correction of its trim using various devices and apparatus already usually provided on-board most boats and, in particular, without weighing down the boat with ballast water.

It is understood that the invention is not limited to the embodiment described and illustrated herein, which is to be regarded as an example of embodiment of the system; the invention may instead be subject to modifications relating to the form and arrangement of parts, constructional and operational details, and control and operating procedures of the devices (pump 12, actuators 17, 18) which are used to reduce the roll.

What is claimed is:

1. A system for reducing the roll of a boat, comprising:

a first fuel tank and a second fuel tank which are situated on opposite sides of a central longitudinal axis of a boat;

an inclinometer which is able to provide electric signals indicating the inclination of the boat about its longitudinal axis;

at least one pipe which connects hydraulically the two tanks;

pumping means operationally associated with said pipe;

an electronic processing and control unit for acquiring and processing said signals from the inclinometer and for operating the pumping means, depending on said signals, so as to transfer fuel from one tank to the other in order to reduce the inclination of the boat;

wherein the unit is preset to prevent operation of the pumping means depending on signals received from the inclinometer indicating that the frequency of the oscillations of the boat about the longitudinal axis exceeds a predetermined frequency value.

2. A system for reducing the roll of a boat, comprising:

a first fuel tank and a second fuel tank which are situated on opposite sides of a central longitudinal axis of a boat;

an inclinometer which is able to provide electric signals indicating the inclination of the boat about its longitudinal axis;

at least one pipe which connects hydraulically the two tanks;

pumping means operationally associated with said pipe;

an electronic processing and control unit for acquiring and processing said signals from the inclinometer and for operating the pumping means, depending on said signals, so as to transfer fuel from one tank to the other in order to reduce the inclination of the boat; and two hydrodynamic fins which are mounted on opposite sides of the longitudinal axis of the boat and can be operated by respective actuator means which are operationally connected to an electronic unit, the unit being preset to cause operation of each actuator means in a varied or selective manner in order to reduce the inclination of the boat.

3. The system of claim 2, wherein the unit is preset to receive from the on-board instrumentation signals indicating the speed of the boat, process data which can be obtained from these speed signals and cause operation of the actuator means when these signals indicate that the speed of the boat exceeds a predetermined value.

4. The system of claim 2, wherein the unit is preset to perform in a co-ordinated manner and/or prevent selectively operation of the pumping means and the actuator means depending on the inclination signals supplied by the inclinometer and/or in response to the speed signals supplied by the on-board instruments.

5. The system of claim 1, further comprising a low level sensor mounted in each tank and able to provide a low level signal; the unit is preset to receive and process this low level signal so as to prevent the removal of fuel from any one of the tanks when the fuel level in that tank is situated below a predetermined threshold.

6. The system of claim 1, further comprising a high level sensor mounted in each tank and able to provide a high level signal; the unit is preset to receive and process this high level signal in order to prevent the supply of fuel to any one of the tanks when the level of the fuel in that tank is situated above a predetermined threshold.

* * * * *